United States Patent [19]

Houben

[11] 3,932,905

[45] Jan. 20, 1976

[54] METHOD OF DYEING A TEXTILE WEB

[75] Inventor: Heinz Houben, Monchengladbach, Germany

[73] Assignee: A. Monforts, Monchengladbach, Germany

[22] Filed: Aug. 19, 1974

[21] Appl. No.: 498,532

[30] Foreign Application Priority Data

Aug. 21, 1973 Germany ..... 2342128

[52] U.S. Cl. ..... 8/149.1; 8/149.3; 8/151; 68/5 D; 68/19.1; 68/20; 68/22 R; 68/62; 68/204

[51] Int. Cl.[2] ..... D06B 21/00

[58] Field of Search ..... 8/149.1, 149.3, 151, 152, 8/151.2; 68/5 D, 5 E, 19, 19.1, 20, 22 R, 22 B, 62, 200, 202, 204, 28

[56] References Cited

UNITED STATES PATENTS

| | | | |
|---|---|---|---|
| 2,424,857 | 7/1947 | Scull | 8/151 X |
| 2,696,098 | 12/1954 | Erikson et al. | 68/20 X |
| 3,260,078 | 7/1966 | Balassa | 68/202 |
| 3,701,269 | 10/1972 | Wilcox | 68/62 X |

FOREIGN PATENTS OR APPLICATIONS

| | | | |
|---|---|---|---|
| 8,320 | 4/1966 | Japan | 68/19.1 |

*Primary Examiner*—Harvey C. Hornsby
*Assistant Examiner*—Philip R. Coe
*Attorney, Agent, or Firm*—Herbert L. Lerner

[57] ABSTRACT

Method of dyeing a textile web having a relatively large volume or relief-like construction which includes immersing the web in a dye solution having a dye concentration corresponding to the quantity of liquid to be squeezed from the web in a subsequent dewatering step, passing the web between two absorbent endless entrainer members of a squeeze foulard that are continuously saturated with the dye solution prior to engagement of the endless entrainer members with the web, and squeezing the web in the foulard so as to dewater it to less than substantially 40% moisture with respect to dry weight of the web, then passing the web through an infra-red channel at an adjusted relatively low drying velocity so as to prevent the formation of cloudiness in the dye distribution and drying the web to a final moisture content of at most 5% with respect to dry weight of the web, and subsequently completing the steps of the dyeing process per se.

5 Claims, 1 Drawing Figure

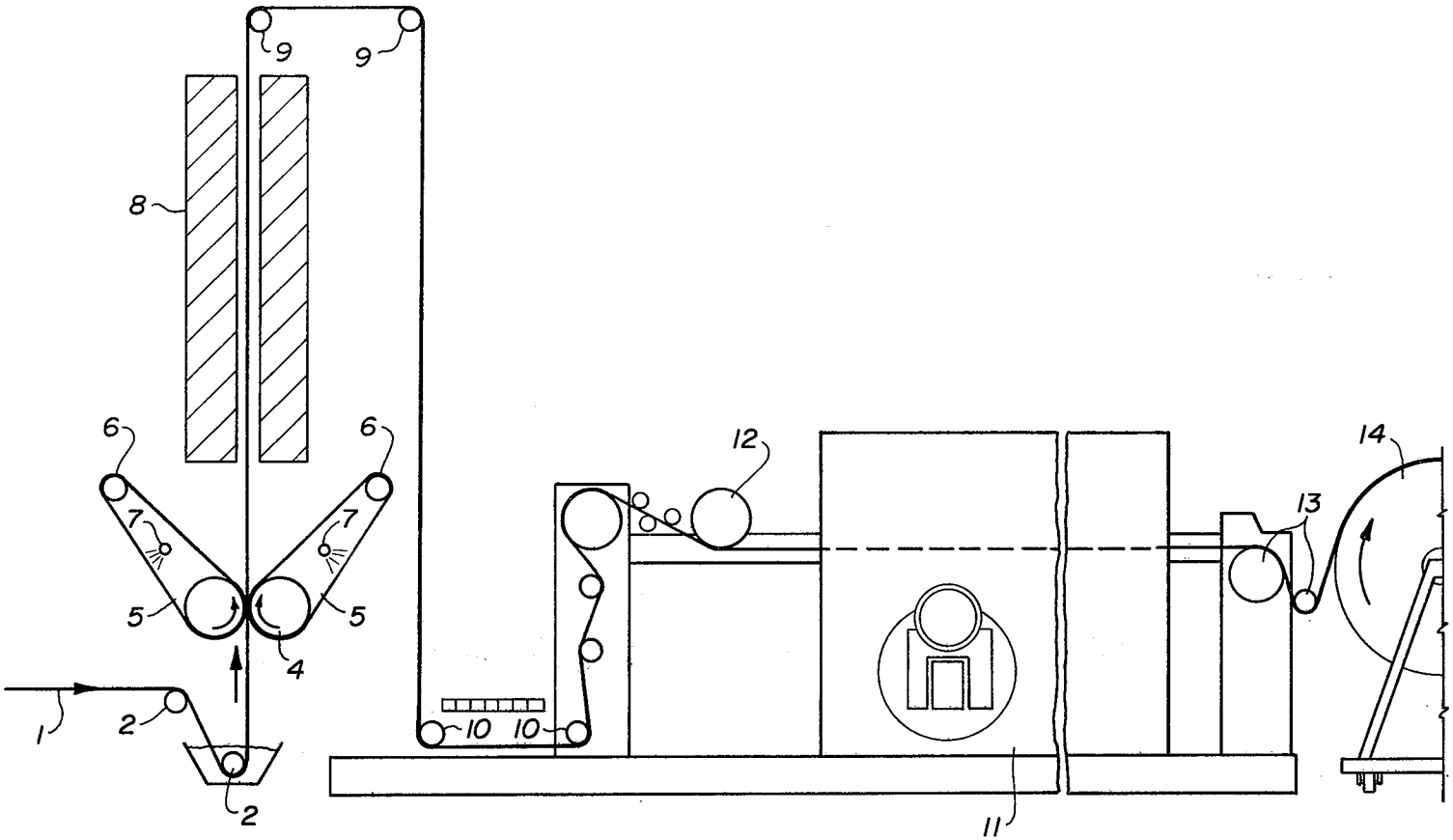
1
2
2
4
5
5
6
6
7
7
8
9
9
10
10
11
12
13
14

METHOD OF DYEING A TEXTILE WEB

The invention relates to a method of dyeing, especially of thermosoling, a relatively voluminous textile web. This method serves to develop or fix the dye in a continuous operation, as opposed to a batch-type operation. For example, dispersion dyes, anionic or cationic dyes for dyeing polyester, polyamide, polyacrylonitrile or similar fibers or mixtures thereof are developed or fixed or are both developed and fixed on the web in a steaming device or in a thermo-chamber. A prerequisite of these processes is that a dehydration or drying of the web takes place after it has been subjected to the respective dyeing liquid.

In this regard, three drying stages or sections can be basically distinguished (note the publication "Trocknungstechnik" [Drying Engineering], Krischer and Kröll, Springer Publishing, 1956, page 233 *ff*). The first drying stage or section begins at a high moisture content. In that drying stage, the vaporization of the moisture at the surface, at which in this phase saturated vapor pressure always exists, is approximately constant, and consequently the drying speed is also constant. This drying operation wherein the surface water is removed is maintained until the capillary liquid transport from the interior to the surface becomes smaller than the quantity of water per unit of time vaporized until then. At this break point of the drying operation, the liquid content in the surface becomes zero. With reducing drying speed, the vaporization no longer occurs at the surface, but rather in the interior of the web, namely essentially within the capillaries thereof. The greatest part of this second drying phase or section, wherein the capillary-water is essentially removed, has received the designation "Final Drying", generally, in the drying of textile webs, because a third drying phase or section wherein the molecular water can be removed is of no interest in this case.

Squeeze foulards, suction devices, infra-red channels or similar devices are employed for dehydrating or de-watering textile webs. In a so-called pre-drying phase, the first drying stage or section mentioned hereinabove must be traversed, that is, the aforementioned break point in the drying operation must be reached or exceeded, because otherwise, at the aforementioned final drying in the second drying stage or section in a next-succeeding machine (contact or convection drying) an undesired migration of the dye into the initially dried regions of the web may occur. Moreover, when surface water is present, spotting i.e. the formation of spots, on the guide members of the machine may take place.

Since the greatest part of the liquid originating from the immersion of the web in the dyeing liquid or bath can be removed by squeezing the same out of the web, the latter is passed through a squeeze foulalrd generally immediately after it has left the dye bath or trough. If one wishes to operate economically or efficiently in this case, about 60% moisture with respect to the dry weight of the cloth or web must be squeezed out. If such is not the case i.e. if 60% of the moisture is not squeezed out, attainment of the low-starting moisture required for the dye-development or fixing process can be achieved, in fact, by over-dimensioning a succeeding infra-red channel, which necessitates, however, excessively or unreasonably high energy costs in the infra-red channel, so that the entire process can be unprofitable.

Numerous types of textile webs exist, however, which cannot be adequately dewatered with conventional squeeze foulards. In this category are all kinds of relief-like mesh goods, cloth webs or textured yarns, especially thick, tufted or voluminous webs or the like; such webs, when squeezed, being on the whole either not reduced in moisture at all to the desired extend or at the very least being considerably damaged due to the great line pressure exerted thereon in the squeeze foulard. Basically, if a dye migration from the inner region into the outer regions of such webs is to be prevented during "final drying" in hot flues, tensioning frames and the like, moisture values must be attained before final drying that are, for example, in cotton fibers $<$ 30% water content, in rayon fibers $<$ 40% water content, and in polyester fibers $<$ 1% water content. With these water contents, the dye development or fixing, in itself, is able to be effected by vaporization or contact or convection drying. At any rate, the moisture content is still so high that guide members can form marks on the web. An effort is made, therefore, during the pre-drying or first drying phase or section to dewater even further than would even be required for limiting the migration.

It is accordingly an object of the invention to provide a method of dyeing a textile web wherein the foregoing requirements for drying the web are readily met even for very voluminous or relieflike patterned cloth webs or webs of textured yarns.

With the foregoing and other objects, there is provided in accordance with the invention, a method of dyeing a textile web having a relatively large volume or relief-like construction which comprises immersing the web in a dye solution having a dye concentration corresponding to the quantity of liquid to be squeezed from the web in a subsequent dewatering step, passing the web between two absorbent endless entrainer members of a squeeze foulard that are continuously saturated with the dye solution prior to engagement of the endless entrainer members with the web, and squeezing the web in the foulard so as to dewater it to less than substantially 40% moisture with respect to dry weight of the web, then passing the web through an infra-red channel at an adjusted relatively low drying velocity so as to prevent the formation of cloudiness in the dye distribution and drying the web to a final moisture content of at most 5% with respect to dry weight of the web, and subsequently completing the steps of the drying process per se.

In accordance with another feature of the invention, after passing the web through the infra-red channel, the web is steamed to develop the dye.

In accordance with an alternate feature of the invention, after passing the web through the infra-red channel, in a thermosoling process, the web is subjected to a permissibly higher temperature to increase the rate of diffusion of the dye in the fibers of the web, and the dye is fixed without stretching the width of the web.

By using a squeeze foulard with two endless entrainer members, the web is treated the same say on both sides thereof. Thus, in the treatment according to the invention there is no difference in the dye between the right and the left-hand side of the web. On the other hand, only one entrainer member would provide virtually the same effect as the two entrainer members used in the invention of the instant application for the purpose of dewatering the web. It is also advantageous to continuously saturate the entrainer members with dyeing liquid. The saturation can be produced advantageously by spraying the entrainer members from the rear thereof. Dur to the use of two entrainer members, not only is a uniform dyeing of both sides of the cloth web achieved but also due to the bloating or sponge effect in the nip between the squeeze rollers of the squeeze foulard, an inner distribution of the dye within the web is attained i.e. the web is provided uniformly through-and-through with dye.

When there is to be a change in a dye stuff, it is generally most expedient not to clean the previously used entrainer members, but rather, to replace them with entrainer members provided for the new dyestuff. Consequently, the valuable opeating time of the foulard, which would otherswise be used for cleaning the entrainer members, would thereby be saved.

In the aforedescribed step of the method of the invention, namely the squeezing step, depending upon the fiber mixture or composition of the web, moisture remainders of 25% with respect to the dry weight of the web are readily attainable. It is therefore essential that this enormous squeezing effect be taken into account beforehand through the appropriate selection of the dye concentration. If the greatest part of the absorbed dyeing liquid is to be squeezed out again immediately, then namely the remaining absolute quantity of dye must remain exactly as great as before for lower squeezing effects.

The squeeze effect proper is, amongst others, a function of fiber mixture and fiber type, cloth weight, type of thread tying, speed of operation of the squeeze foulard and the linear pressure applied thereby.

In addition to the squeezing step, the cloth web is conducted, in accordance with the invention through a stepless or infinitely regulatable infra-red heating channel. Drying of the web is therein driven to a final moisture content of at most 5% with respect to the dry weight of the web and, in fact, the operation is carried out therein with most minimal drying speed so that steam-like or vapor-like cloudiness cannot occur in the dye distribution. The relatively slow drying speed, of course, requires a correspondingly long infra-red channel; however, because of the slight energy requirement and, naturally, because of the preceding good squeezing effect, correspondingly low operating costs are ensured.

The textile web which leaves the infra-red channel with at most 5% water content is thus virtually already dried finally. It is, in all cases, so dry that it can be guided like a fully dried web over guide members, such as widening rollers, for example, without marking the guide members.

In a succeeding dye-fixing operation in a thermosol process, the web of itself can be guided through any desired convection or contact dryer. It has been found, however, especially for articles of textured yarn, that the best feel of the cloth or textile material is attained with short durations if the web is fixed without any essential stressing or stretching of the width thereof. A diminution of the duration period requires an increase in the fixing temperature, however. In accordance with an additional feature of the invention, therefore, a so-called suspension dryer is used in the fixing process, as is described, for example, in German Published Prosecuted Application DAS No. 2,120,805. Whereas one could fix dyes on textile webs of texturized polyester yarns only with temperaturees of 160°C at most on conventional tensioning frames, it is possible, with suspension driers, to operate at temperatures up to 185°C. At the latter temperatures in suspension driers, the speed of travel of the textile web therethrough can be set substantially twice as fast as heretofore for tensioning frames operating at lower temperatures. The suspension driers thus not only render the desired short duration possible but, because of the shorter duration, also requires only half of the time to fix the dye than in the heretofore employed tensioning frames. This feature of the invention is consequently advantageously unexpected.

If the textile webs being treated in accordance with the method of the invention contain no texturized yarn or no considerable component of such yarns, it is also advantageous, in accordance with the invention, to employ cylinder fixing machines or thermo hot flues as thermosol aggregates or assemblies.

In the dye developing and/or fixing of dispersion dyestuffs or the like, quite short processing periods or durations suffice. For example, for a suspended loop streamer operating at 180°C, four minutes of steaming time are sufficient. It is expecially advantageous that the cloth web be presented virutally dry so that no danger of marking the supporting rollers of the steamer exists.

Other features which are considered as characteristic for the invention are set forth in the appended claims.

Although the invention is illustrated and described herein as method of dyeing a textile web, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the single FIGURE of the drawing which is a diagrammatic view of apparatus for carrying out the method of dyeing a textile web according to the invention.

Referring now to the drawing, there is shown therein a textile web, that is wholly or partly formed of texturized yarn, which is to be thermosoled. The textile web 1 initially travels over guide rollers 2 through a dye solution. Directly thereafter, it is conducted through the nip between a pair of squeeze rollers of a aqueeze foulard 4. An endless entrainer device or belt 5 is disposed around each roller of the squeeze foulard 4 and is respectively stressed by a roller 6. The entrainer 5, during operation, is continuously saturated through being sprayed by dye liquid from nozzles 7. After running through the foulard 4, the textile web 1 reaches an infra-red channel 8 whereat it is dried to a prescribed final moisture content.

After the textile web 1 has attained the final moisture content thereof, it is passed over guide rollers 9 and 10 to a suspension drier 11. In the embodiment of the invention, the suspension drier involved therein is substantially of the type disclosed in German Published Prosecuted Application DAS No. 2,120,805. Depending upon the desired type and the quality of the textile web, a suspension drier with or without needle insertion at the edge of the textile web can be used. Such a machine in the form of a tensioning machine is shown and described herein. In the disclosed embodiment of the invention, needle insertion at the edge of the textile web is employed by means of needle inserting brushes 12. In connection with and following the suspension drier 11, the textile web 1 passes over the rollers 13 and is wound directly on a take-up roll 14. The take-up roll or winder 14 is of the type disclosed in the German Published Non-prosecuted Application DAS No. 2,314,279.

I claim:

1. Method of dyeing a textile web having a relatively large volume or relief-like construction which comprises immersing the web in a dye solution having a dye concentration corresponding to the quantity of liquid to be squeezed from the web in a subsequent dewatering step, passing the web between two absorbed endless entrainer membrs of a squeeze foulard that are continuously saturated with the dye solution prior to engagement of the endless entrainer members with the web, and squeezing the web in the foulard so as to dewater it to less than substantially 40% moisture with respect to dry weight of the web, then passing the web through an infra-red channel at an adjusted relatively low drying velocity so as to prevent the formation of cloudiness in the dye distribution and drying the web to a final moisture content of at most 5% with respect to dry weight of the web.

2. Method of dyeing according to claim 1 which includes, after passing the web through the infra-red channel, steaming the web so as to develop the dye.

3. Method of dyeing according to claim 1 which includes, after passing the web through the infra-red channel, subjecting the web to a permissibly higher temperature to increase the rate of diffusion of the dye in the fibers of the web and fixing the dye without stretching the width of the web.

4. Method of dyeing according to claim 1 which includes, after passing the web through the infra-red channel, fixing the dye in the web without stretching the web width by passing the web through a suspension drier.

5. Method of dyeing according to claim 1 which includes, after passing the web through the infra-red channel, developing the dye on the web by passing the web through a suspended loop steaming device.

* * * * *